United States Patent [19]

Skowasch et al.

[11] Patent Number: 5,022,325

[45] Date of Patent: Jun. 11, 1991

[54] FUZE FOR BOMBLET PROJECTILE

[75] Inventors: Gerhard Skowasch, Gelsenkirchen; Udo Sabranski, Willich; Jürgen Funk; Siegfried Quick, both of Düsseldorf, all of Fed. Rep. of Germany

[73] Assignee: Rheinmetall GmbH, Düsseldorf, Fed. Rep. of Germany

[21] Appl. No.: 559,936

[22] Filed: Jul. 30, 1990

[30] Foreign Application Priority Data

Jul. 29, 1989 [DE] Fed. Rep. of Germany ..... 3925238

[51] Int. Cl.[5] ..... F42B 12/58; F42C 14/06; F42C 15/22; F42C 15/34

[52] U.S. Cl. ..... 102/226; 102/227; 102/245; 102/269; 102/393

[58] Field of Search ..... 102/226–229, 102/242, 245, 269, 385, 386, 388, 393, 489

[56] References Cited

U.S. PATENT DOCUMENTS

| | | | |
|---|---|---|---|
| 3,913,483 | 10/1975 | Wolterman | 102/226 |
| 3,998,164 | 12/1976 | Hadfield | 102/226 |
| 4,004,514 | 1/1977 | Daniels | 102/385 |
| 4,455,940 | 6/1984 | Furuike | 102/230 |
| 4,715,282 | 12/1987 | Rosenberg et al. | 102/227 |
| 4,762,066 | 8/1988 | Rüdenauer et al. | 102/393 |
| 4,777,879 | 10/1988 | Bueno et al. | 102/230 |
| 4,811,664 | 3/1989 | Levy et al. | 102/393 |
| 4,873,927 | 10/1989 | Rüdenauer | 102/226 |

FOREIGN PATENT DOCUMENTS

| | | |
|---|---|---|
| AL 0284923 | 5/1988 | European Pat. Off. . |
| 3524080 | 1/1987 | Fed. Rep. of Germany . |

*Primary Examiner*—David H. Brown

*Attorney, Agent, or Firm*—Spencer & Frank

[57] ABSTRACT

A fuze for a bomblet projectile of the type including a primary firing pin mounted in a housing for axial displacement in the longitudinal direction and a detonation charge carried by a slide disposed in the housing for displacement in a direction transverse to said longitudinal direction of the housing, between a safety position, wherein the detonation charge is not aligned with the primary firing pin, and an armed position, wherein the detonation charge is aligned with primary firing pin. To further improve the firing and safety devices of such fuzes and permit safe pick-up of duds, a lateral recess is provided in a side surface of the slide in the form of a longitudinal groove so that the movement of the slide, if minimum centrifugal forces are no longer present, can be arrested in an intermediate position by renewed engagement of a spring tensioned safety pin in the recess. In this intermediate position the detonation charge remains off center or non-aligned with the primary firing pin, in an interrupted line of ignition. Moreover, in the intermediate position, the slide and in particular ignition element for a self-destruct charge carried by the slide, remains spaced from second firing pin disposed laterally in the housing at the armed position.

17 Claims, 4 Drawing Sheets

FUZE FOR BOMBLET PROJECTILE

REFERENCE TO RELATED APPLICATIONS

This application relates to, and incorporates herein by reference, concurrently filed U.S. patent application Ser. Nos. 07/559,346 and 07/559,350 corresponding respectively to Federal Republic of Germany applications Nos. P 39 25 235.3 and P 39 25 236.1, both filed July 29th, 1989.

This application further claims the priority of Federal Republic of Germany application Serial No. P 39 25 238.8 filed July 29th, 1989, which is incorporated herein by reference.

BACKGROUND OF THE INVENTION

The present invention relates to a fuze for an explosive projectile, particularly a submunition projectile (bomblet), with the fuze being of the type including an axially displaceable firing pin and a slide displaceable transversely to the longitudinal direction of the fuze housing and the projectile and provided with a detonation charge between a safety position, wherein the detonation charge is not aligned with the primary firing pin, and an armed position, wherein the detonation charge is aligned with the primary firing pin.

Bomblet projectiles are submunition projectiles, that is, secondary projectiles, which are transported in large numbers, e.g. sixty three bomblet projectiles arranged in seven rows, each containing nine bomblet projectiles, by a large-caliber carrier projectile over distances up to 30 km to above a target area and are there ejected at a height of, for example, 300 m. While the bomblet projectiles are dropping down or descending, they are mechanically set to detonate.

European published application No. EP-A 0,284,923, corresponding to U.S. Pat. No. 4,811,664 discloses a bomblet fuze provided with a safety device which includes a safety pin actuated by the action of centrifugal forces. To arrest the slide, the safety pin is configured to engage in a corresponding recess in the slide. The slide includes an ignition element or primer, which is ignited by a second firing pin, for a pyrotechnic delay path for self-destruction of the projectile if the primary firing pin did not cause the fuze detonator to act upon impact on the target. This may happen, for example, if such a secondary projectile (bomblet) ejected from a carrier projectile lands on soft ground, in a swamp, in snow, in tree branches, in high grass or in a camouflage net. The drawback of the prior art bomblet construction is the fact that, with the fuze in the armed position, the slide projects laterally far and unprotected from the fuze housing. This could very easily cause malfunctions, for example in rainy weather, in the initiation of the detonation charge or in the exposed ignition element of the delayed charge for the self-destruct function.

Another drawback is the arrangement of the second firing pin for igniting the detonator element at the outer unprotected end of the slide itself which projects far out from the side of the fuze housing. The second firing pin is provided with a heavy percussion or striking member and is rotatably fastened to the slide by means of a pin. If the fuze is armed by displacement of the slide out of the side of the fuze housing, centrifugal force from the inherent rotation of the bomblet should make the striking member effective and the solid firing pin should perform a movement of about 90° on a small-radius partial circle and enter into the ignition element. The shape of the tip of the firing pin is solidly conical and flattened on one side, possibly in order to facilitate the penetration into the ignition element on a small circular arc. This fuze construction has the further great drawback that the slide which projects far from the fuze housing and its heavy firing pin-percussion member on the outside produces great eccentricities during rotation and thus destabilizing forces which act on the bomblet.

Moreover, if the projectile spins only slightly or there is insufficient centrifugal force, it may happen during the transverse displacement of the slide that the slide is displaced outwardly and the pivotal solid firing pin and the percussion member are released, but the striking energy for igniting the pyrotechnic delay composition is insufficient to self-destruct the projectile and the slide is not arrested in its outer armed position (see FIG. 6: Spring pin 24 at housing projection 25 of this reference). Another drawback for the free displaceability of the slide is that, for example, a spring biased pin (24) always exerts friction, that is a braking effect, between the slide and the housing. Moreover, once the spin is reduced and there is no longer any centrifugal force, a spring tensioned safety pin (27) also constantly presses against the side wall of the slide, and its friction and deceleration effect also acts against the displaceability of the slide.

If such a bomblet hits a soft target, the detonation charge may not be ignited by the first axially displaceable firing pin. Such a bomblet then lies around in the terrain as a dangerous dud and may be caused to explode at once by the first firing pin due to shock or impact, for example, if hit by a foot, or it may be activated for a delayed explosion by the second firing pin.

SUMMARY OF THE INVENTION

It is an object of the present invention to further improve the detonator and safety device of an explosive projectile, particularly a bomblet projectile. In particular, it is intended to ensure that duds can be safely picked up. Moreover, operational reliability is to be increased under consideration of an improved and simplified manufacture (assembly) and reduction of weight.

The above object is generally accomplished according to the present invention by a fuze for an explosive projectile, particularly a submunition projectile (bomblet), which is of the type including: a fuze housing; a primary firing pin mounted in the housing for axial displacement in the longitudinal direction; a detonation charge carried by a slide disposed in the housing adjacent the primary firing pin, with the slide being mounted in the housing for displacement in a direction transverse to the longitudinal direction of the housing, and to its center longitudinal axis, between a safety position, wherein the detonation charge is not aligned with the primary firing pin, and an armed position, wherein the detonation charge is aligned with the primary firing pin; and which further includes: safety means, responsive to centrifugal forces acting on the fuze, for permitting movement of the slide toward the armed position, and for preventing further movement of the slide toward the armed position beyond an intermediate position, wherein the detonation charge is likewise not aligned with the primary firing pin, if the slide is not in the armed position once a given centrifugal force is no longer present the safety means includes a first safety pin slidingly mounted in a first opening which is disposed in a side wall of the fuze housing adjacent a first side surface of the slide and which extends transverse to the displacement direction of the slide and to the housing longitudinal direction, a spring fastened to the housing and urging the first safety pin in a direction toward the first side surface of the slide, and a first recess formed in the first side surface of the slide and into which a first end of the first safety pin can extend, with the first recess being an elongated groove extending along the first side surface and having a trailing edge positioned to prevent movement of the slide beyond the intermediate position when engaged by a circumferential surface of the safety pin adjacent its first end. Preferably the fuze further comprises a self destruct means, which is provided in said slide and includes an ignition element disposed at a leading edge surface of the slide, for causing self destruction of at least the fuze after a given time delay following ignition of the ignition element, and a second firing pin mounted at a side wall of the fuze housing at a position facing the leading edge surface of the slide for causing ignition of the ignition element upon displacement of said slide into said armed position; and the leading edge of the slide is spaced from the second firing pin when the slide is in the intermediate position.

If for some reason the slide remains stuck in front of the laterally disposed second firing pin without initiating the self-destruct composition, the spring biased safety pin engages into the extended catch groove disposed on the side surface of the slide as soon as the bomblet has only a slight or no more rotational velocity (braking of spin by soft impact on the target), and arrests the slide so that no further initiation of the detonation charge by the first or primary firing pin or of the self-destruct charge by the second firing pin is possible as a result of external shocks.

The invention will be described in greater detail with reference to embodiments thereof that are illustrated in the drawing figures.

DETAILED DESCRIPTION OF THE PREFERRED EMBODIMENT

Figure 1:
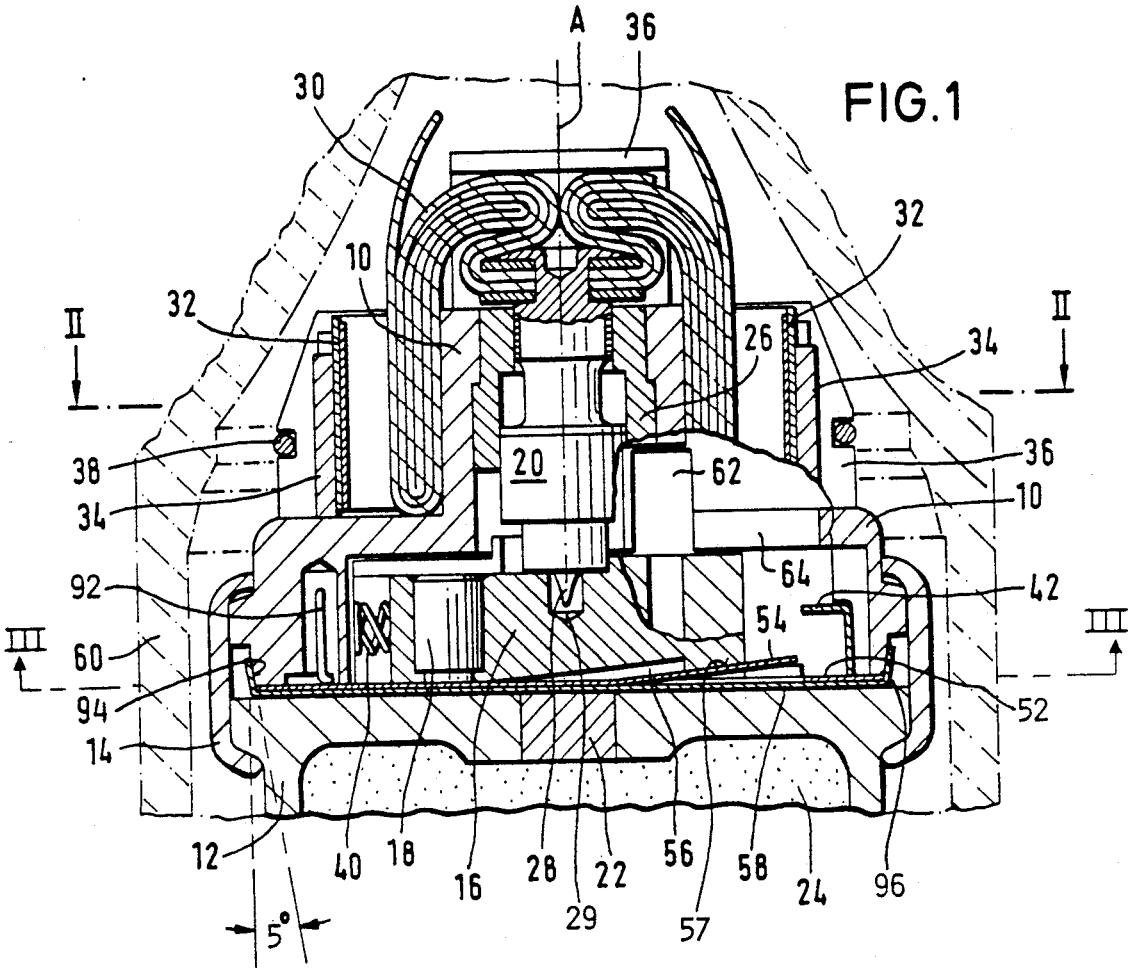
FIG. 1 is a longitudinal sectional view, partially broken away, of a bomblet fuze according to the present invention in the safety position.

Referring now to FIG. 1, there is shown a fuze housing 10 which is firmly fixed by means of a holding ring 14 on a bomblet housing 12. Within fuze housing 10, there is disposed a slide 16 which contains a detonator charge 18 and which is displaceable transversely to the longitudinal or center axis A of the bomblet projectile, and thus of the fuze housing 10.

FIG. 1 shows slide 16 in the safety position in which the detonator charge 18 is displaced laterally out of the straight line between a primary firing pin 20 disposed in the fuze housing 10 and a booster charge 22 disposed in the upper bomblet housing 12 to detonate the primary explosive charge 24. In a known manner, the centrally disposed primary firing pin 20 is connected via a screw connection with a casing 26 which serves as an additional striking mass and which is axially displaceable within the fuze housing 10. In the illustrated safety position, firing pin 20 is screwed into casing 26 so that the pin is supported upwardly and rearwardly against a housing projection in fuze housing 10. At the front, tip 28 of primary firing pin 20 projects into a recess (blind bore) 29 disposed on the upper surface of the slide 16, and thus fixes slide 16 in the safety position.

Figure 2:
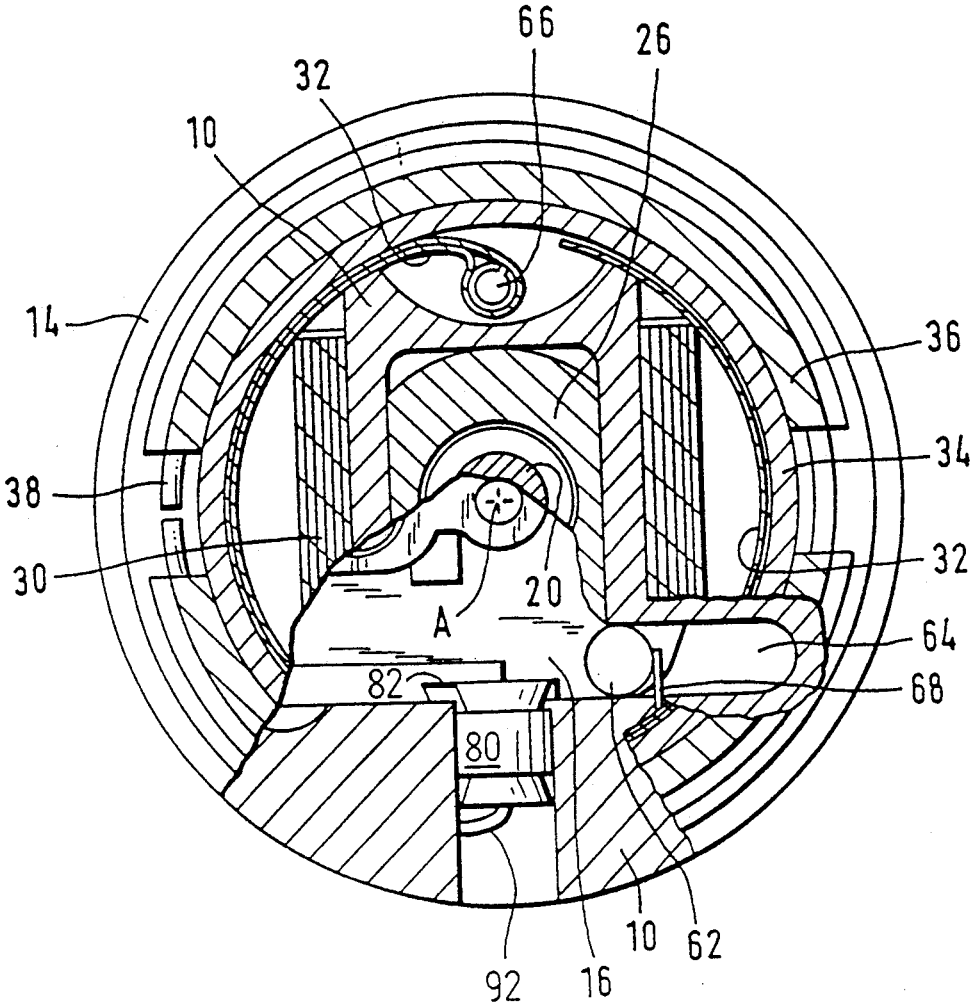
FIG. 2 is a cross-sectional view, partially broken away, of the fuze according to the invention in the direction II—II of FIG. 1.

A folded-together stabilization loop 30 is fastened to the end of primary firing pin 20 projecting from fuze housing 10. On the exterior of fuze housing 10 and enclosing the upper, smaller diameter region of fuze housing 10, two radially outwardly pivotal spin braking fins 32 are each fastened to a respective longitudinally extending holding or pivot pin 66 (FIG. 2). These fins 32 are made, for example, of a thin steel sheet and are bent in the form of a semicircle. A safety band 34 is wound around the folded-in or non-deployed spin braking fins 32.

In their wound position, safety band 34 and stabilization loop 30 are held by a hood-like, two-part plastic safety shell 36 which is pushed over them and which, in turn, is held in its position by a spring steel safety ring 38.

During transport into a target area by means of a large-caliber carrier projectile which can be fired over large distances, for example 30 km, the secondary projectiles (bomblets) are stacked within the carrier projectile in the form of space saving columns. FIG. 1 shows, in dashed lines, such an adjacent bomblet 60 which completely covers fuze housing 10. Fuze housing 10 projects far into the conical free space provided by the shaped charge liner of the adjacent bomblet 60.

When the bomblet projectiles are ejected from the carrier projectile over the target area by means of an ejection charge and the stack arrangement no longer exists, several steps take place in timely succession within a predetermined period of time from the bomblet fuze being in the safety position until it is set to detonate.

Initially, stabilization loop 30 on the exterior is pulled out of its folded-in rest position and unfolded, and at the same time, the two safety shells 36 and safety ring 38 are released from fuze housing 10 and release safety band 34. Then the discardable safety band 34 is unwound and releases the spin braking fins 32 which, due to the centrifugal forces caused by rotation, pivot outwardly and reduce the spin of the bomblet projectile which now drops in a stabilized manner.

Once stabilization loop 30 has been unfolded, a torque acts on firing pin 20 causing it to be screwed somewhat toward the rear, out of casing 26. This causes the tip 28 of firing pin 20 to come out of the recess 29 in the upper surface of slide 16 so that the slide 16 is able to be displaced laterally, if further separately acting safety arrangements likewise have been released, into its armed position with the detonator 18 aligned with the firing pin 20, so that the fuze is set to detonate upon impact.

Additionally disposed in the fuze housing 10 in the path of movement of the slide 16 is a further or second firing pin 42 which, when the slide 16 has reached the armed position, ignites a self destruct arrangement, including elements 44, 46, 48 and 50 (see FIG. 3), which is disposed in slide 16 and which will cause the detonator charge 18 to be activated after a given time delay. This acts as a safety measure to destroy the projectile if, by the end of the given time delay, the primary firing pin 20 has not activated the charge 18 due to impact with an object, e.g. due to falling on very soft ground or in deep snow. The second firing pin 42 is formed as a bent portion of a sheet metal disc 52 disposed in the bottom of the housing 10 adjacent the bottom of the slide 16 and is held in housing 10 by means of a sheet metal hood or cover 58 which engages the exterior surface of the housing 10. The disc 52 is likewise provided with an upwardly extending spring tab 54 which engages in a recess 56 formed in the bottom surface of the slide 16 when the slide has moved to the armed position and thus arrests further movement of the slide 16.

As a further safety device for the fuze according to the invention, a safety pin 62 is arranged on the upper surface of the slide 16 so as to extend parallel to the center axis A. Fuze housing 10 is provided with a corresponding opening 64 for the safety pin 62 so that the pin 62 disposed on the slide 16 can take up a position within the fuze housing 10 adjacent the portion of an opening 64 in the smaller diameter upper portion of the housing 10 when the slide 16 is in the safety position (as shown in FIGS. 1 and 2), and an end position outside of fuze housing 10 once slide 16 has been moved laterally into the armed position for the fuze. In the safety position, safety pin 62 is in operative connection with a non-deployed spin braking fin 32 so that slide 16 can be arrested in its safety position. Advisably, as shown in FIG. 2, spin braking fin 32 is provided with an inwardly oriented projection 68 which, when the spin braking fins 32 are not deployed, is in contact at the opening 64 with the safety pin 62 and grips it so as to block and arrest lateral amount of the pin 62, and thus slide 16.

Figure 3:
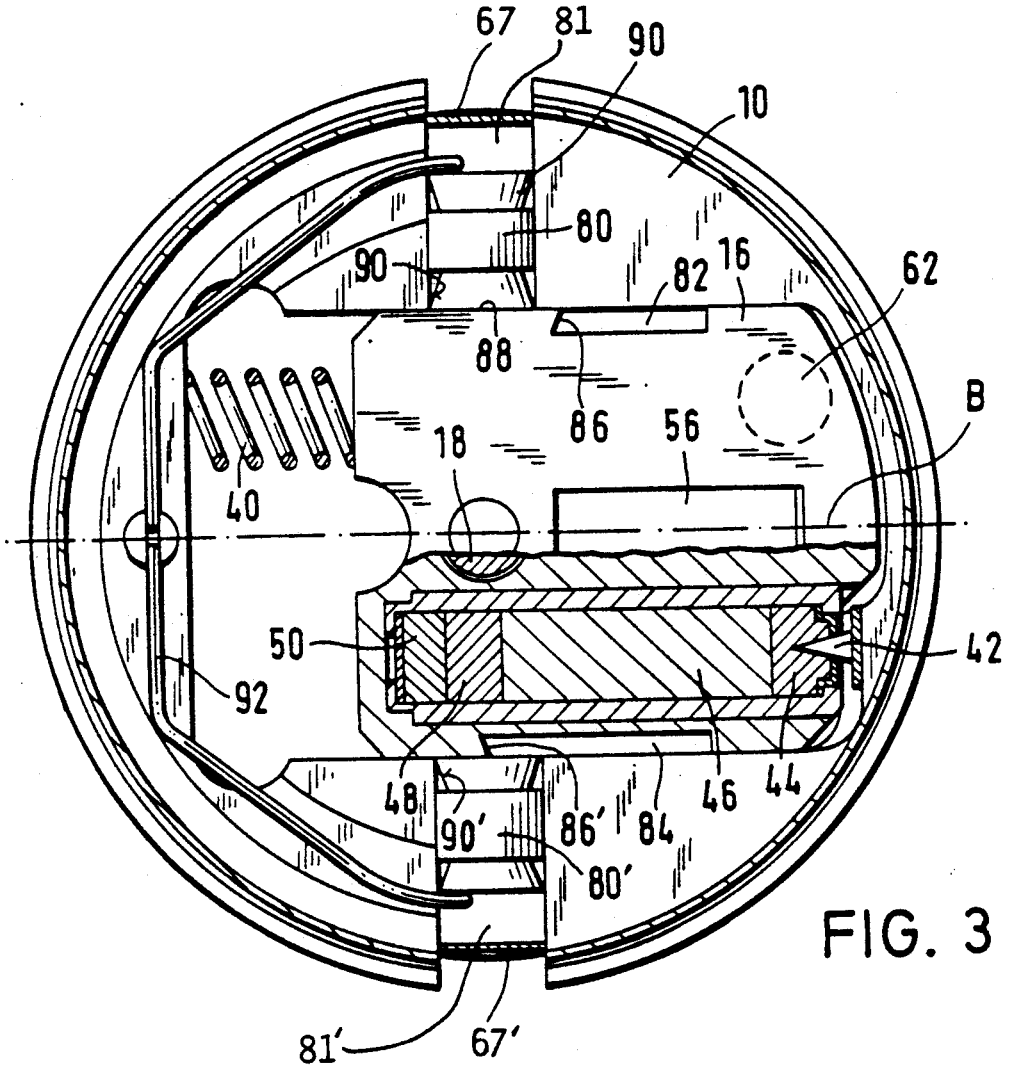
FIG. 3 is a cross-sectional view of only the fuze according to the invention seen along line III—III of FIG. 1 with the fuze in the armed position and with the slide partially in cross-section.

As can be seen in FIGS. 2 and 3, which show the slide 16 in the safety and armed positions, respectively, the fuze is provided with still a further safety device in that the opposed parallel lateral side surfaces or edges of the slide 16 are provided with respective recesses or grooves 82 and 84 which can be engaged by respective safety pins 80 and 80' slidingly disposed in opposed laterally (radially) extending openings 81 and 81' formed in the side wall of the housing 10. The two safety pins 80, 80' are normally urged inwardly toward the side edges of the slide 16 by a double-armed wire spring 92 anchored at its center in the housing 10. As can be seen from FIG. 2, when the slide 16 is in the safety position the safety pins 80 and 80' extend into the respective recesses or grooves 82 and 84 with the position and length of the recess 82 being such that the slide 16 cannot move transversely out of the safety position unless the pin 80 has been withdrawn from the recess due to centrifugal forces acting against the force of the spring 92.

With the fuze arrangement thus far described, in order for the slide 16 to move from the safety position shown in FIGS. 1 and 2 to the armed position is shown in FIG. 3, a number of related operations take place. Centrifugal forces acting on the projectile cause the two safety pins 80 and 80' to move radially out of the recesses 82 and 84, respectively, against the force of the double-armed wire spring 92 to permit centrifugal force and pressure from a compressed spring 40, which is disposed at the rear of the slide 16 within the housing 10, to push slide 16 into the armed position provided the other safety devices have been released. That is, as a further safety, and after ejection of the bomblet projectile from the carrier projection, the firing pin 20 must have been screwed out of the blind bore 29 during this time and the safety pin 62 fastened to slide 16 released by the spin braking fins 32 to permit displacement of the slide 16. When the slide 16 reaches the shown armed position, the self-destruct composition, composed of an ignition element 44, a delay path 46, a booster charge 48 and an explosive charge 50, is initiated by the flat second firing pin 42 disposed in the side of fuze housing 10. Slide 16 is arrested in the armed position against further movement by the upwardly bent spring tab 54 integrated in the spring disc 52 so as to engage in the corresponding recess 56 on the underside of the slide 16. Due to a small inclined step or gradation 57 above spring tab 54 in the underside or surface of slide 16 in front of the recess 56, spring tab 54 is caused to be depressed advantageously only if slide 16 is displaced. Thus, no disadvantageous stress occurs on spring tab 54 while the slide 16 is in the safety position, and no constant friction lock connection exists between slide 16 and spring tab 54.

If the slide 16 should have insufficient energy for the secondary firing pin 42 to pierce the ignition element 44 of the self destruct composition, e.g., due to the rotational velocity of the bomblet projectile being too low, the slide 16 does not reach the armed position and stops in front of the second firing pin 42, so that the self-destruct charge will not be ignited, and there can be no ignition of the detonation charge 18 because the latter does not lie accurately in a straight firing line below the primary firing pin 20. Such a bomblet then lies on the terrain as a dangerous dud and may be caused to explode by a shock, e.g. by someone kicking or tripping over the projectile or by a vehicle tire hitting the projectile.

Figure 4:
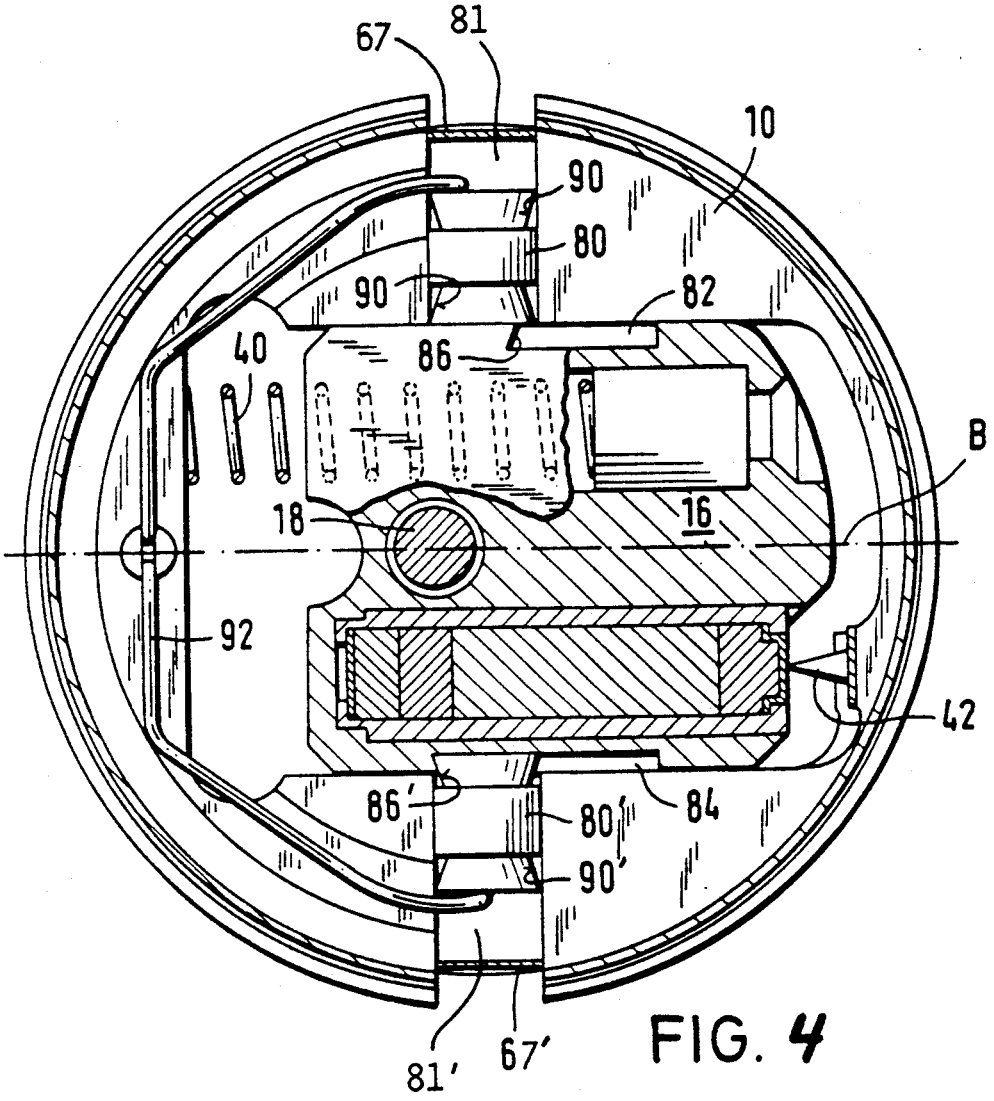
FIG. 4 is a view similar to FIG. 2 showing only the fuze according to the invention in an intermediate safety position.

For this latter case, the configuration of the described bomblet fuze is further modified according to the present invention. In particular, one of the recesses 82 and 84, the recess 84 as shown in FIGS. 3 and 4, is elongated and extended in a direction toward the rear of the slide 16 such that it can be engaged by the safety pin 80' to arrest the slide in an intermediate position as shown in FIG. 4 between the exact armed position and the safety position. As soon as the bomblet has only a very slight or no rotational velocity at all, the force of wire spring 92 causes safety pins 80 and 80' to move inwardly toward the slide 16 and, if the slide is not in the armed position (FIG. 3) causes pin 80' to enter into the extended catch groove or recess 84 (longitudinal groove) and arrest slide 16 in such a manner that the second firing pin 42 remains spaced from the ignition composition 44 of the self-destruct charge, and the detonation charge 18 remains off center in an interrupted line of ignition, unreachable for the first primary firing pin 20. This ensures a safe and reliable picking up for such a bomblet.

Advantageously, as shown in FIGS. 2–4, the respective rear or trailing end surfaces 86 and 86' of the recess 82 and of the longitudinal groove 84, i.e., the end surfaces facing compression spring 40, are provided with a rearward slope or incline, and the circumferential surface 90, 90' of each of the two safety pins 80 and 80' is configured to be correspondingly sloped inwardly from its respective end surface 88, 88' so that the sloped surfaces 80', 90' engage with one another if the pin 80' should engage in the groove 84 to arrest the slide in the intermediate position. Since in each case, two safety pins 80 and 80' are provided in the fuze housing it is advantageous that each safety pin 80, 80' is provided with the sloped frontal circumferential edge surface 90, 90' at both ends as shown. With this double ended arrangement, it is no longer possible, for example, for errors in the installation of the safety pins 80, 80' to occur, with the subsequent inability of the bomblet to function.

The sloping of the meshing safety pin outer edges 90, 90' and the end surface 86, 86' of recess 82 and longitudinal groove 84, respectively, in each case amounts to between 10° to 45°, preferably, however, about 20°. If one of the safety pins 80, 80' is caught in recess 82 or in longitudinal groove 84, the slide 16 can no longer be moved into the armed or ignition position by dropping, impact or rotation. This ensures great handling safety for the fuze. In the normal ignition sequence, the "teeth" or sloped end surfaces 86, 86' of the longitudinal groove 84, 82 and the meshing "teeth" or circumferential end surfaces 90' 90' of safety pins 80, 80' do not come into engagement with one another. That is, in the actual safety position as shown in FIG. 2, the end of the pin 80 is engaged in the recess or groove 82, which is larger than the diameter of pin 80, so that the respective sloped surfaces are not engaged. Since the groove 84 extends rearwardly a substantially greater distance than groove 82, no engagement of sloped surfaces 86' and 90' can take place except during the above described arresting of the slide 16 in the intermediate safety position.

The fuze construction according to the present invention including safety pins 80, 80' which can easily be inserted from the outside into the corresponding bores or recesses 81, 81' in the housing 10, the one-piece wire spring 92 and the closing of the housing recesses 81, 81' after insertion of safety pins 80, 80' by means of respective bent-up flaps 67, 67' of spring disc 52 provide a simple and cost effective way for manufacture and assembly of the individual components.

Advisably, as shown in FIG. 1, the outer circumferential surface 94 at the lower end of the fuze housing 10 is given an inward taper or slope toward the rear of between 1° and 10°, preferably about 5°, to provide for a friction locking engagement (clamped seat) with the peripheral edge flange 96 of the cup-shaped metal covering sheet 58.

This cover 58 and fixation of the inner components in the fuze housing 10 thereby considerably simplify the assembly of the bomblet fuze according to the invention.

In summary, the preferred embodiment of the bomblet fuze according to the invention includes in addition to the customary impact fuze function, a pyrotechnic self-destruct function which is activated after ejection of the bomblets from the carrier projectile. Thus, if impact conditions are unfavorable, e.g., deep powdered snow high operational reliability and low percentage of duds is realized. Moreover, in order to ensure safety in handling, in transport, in the gun barrel and in possible subsequent picking up of a dud, the fuze is provided preferably with three mutually independent separate mechanical safeties which lock the slide 16 serving as the carrier for the detonator 18: (1) the firing pin 20, that is, the firing pin tip 28, which enters into a blind bore 29 in the upper surface of the slide 16; (2) one of the two spin braking fins 32 which presses against the safety pin 62 carried by the slide 16 and projecting through an opening 64 in fuze housing 10; and (3) two safety pins 80' 80' which engage in recess 82 and longitudinal groove 84, respectively, in the slide 16.

The safety pins 80, 80' are intended primarily as transport, handling and pick-up safeties. If the safety furnished by the firing pin 20 and the spin brake fin 32 should malfunction during handling or transport of the bomblet, the compression spring 40 urges slide 16 against the previously movable safety pins 80, 80' which are engaged in the recesses 82, 84 by the spring 92. The conical or sloped teeth 86, 90 of safety pin 80 and slide 16 then take care that the lock will not be released even upon shock or impact. A complete safety release of the bomblet fuze is thus possible only if safety pins 80, 80' release slide 16 before firing pin 20 is unscrewed and the spin brake, that is, the spin braking fins 32, are unfolded. To do this, however, the bomblet must rotate at a certain minimum number of revolutions. While the safety pins 80, 80' of the bomblet fuzes in the bomblet column disposed in the center of the carrier projectile are able already to move outwardly and release the slide 16 after the carrier projectile, and thus the bomblet, has been fired, the safety pins 80, 80' of the bomblet fuzes in the outer bomblet columns disposed along the circumference of the carrier projectile are able to unlock the respective slides 16 simultaneously only after these bomblets have been ejected from the carrier projectile. After ejection of the plurality of bomblets from the carrier projectile, the freely flying bomblets then rotate about their own axis so that the centrifugal force urges safety pins 80, 80' out of recess 82 and catch groove 84 of slides 16 against the force of reset spring 92. In the case of a malfunction of the ejector fuze in the carrier projectile, so that the bomblets remain in the carrier projectile, the safety pins 80, 80' in the bomblets of the center bomblet column also return to the safety position shown in FIG. 2 as soon as the number of revolutions of the carrier projectile falls below the minimum value. After recovery of the carrier projectile, the bomblets can then be disassembled without danger.

As soon as the respective bomblets have separated from one another after ejection from the carrier projectile, centrifugal forces tear the two safety shells 36 away from the fuze housing 10, and the stabilization band 30 unfolds and unscrews the firing pin 20. At the same time, the wound safety band 34, which is now exposed to the flow of air, begins to come loose in layers until the spin braking fins 32 are exposed, resulting in the fins 32 pivoting into the open position and finally releasing safety pin 62 which is fastened on the slide 16. During the time in which the coiled band 34 unwinds, the fuze still remains secured i.e, the slide 16 cannot move to the armed position, and thus, gun barrel safety is ensured. That is, the fuze is armed only after the individual bomblets have moved away from one another after ejection to such an extent that there is only a low probability that they may collide with one another and initiate premature ignition. The completely unlocked and safety released slide 16, accelerated by spring force from spring 40 and centrifugal force, moves into the firing or armed position (FIG. 3) where it is arrested by spring tab 54. At the same time, the pyrotechnic combustion path for delayed self-destruction accommodated in slide 16 is fired. After the expiration of a delay period of, e.g. 15 to 20 seconds, the self-destruct charge ignites detonator 18 if the impact fuze mechanism has failed. The probability of the occurrence of duds is thus reduced considerably.

If the kinetic energy of slide 16 is insufficient to cause the second firing pin 42 to pierce the ignition element 44 of the self-destruct charge, so that the side does not reach the exact armed position, the slide 16 is again caught or arrested by the one of the two spring biased safety pins 80, 80' i.e., the pin 80' as shown, which engages in the longitudinal groove 84 as soon as the rate of rotation of the bomblet has dropped to below a certain minimum number of revolutions. In this position, neither the detonator 18 nor the ignition element 44 of the delay self-destruct charge can be ignited. Although this prevents impact detonation, the bomblet can at least be picked up safely.

The safety pin 62 projecting from fuze housing 10 on slide 16 permits detection of the position of slide 16, and thus permits a simple manner of differentiating between bomblet duds which are due to injection failures and those which are still in the safety position.

The invention now being fully described, it will be apparent to one of ordinary skill in the art that any changes and modifications can be made thereto without departing from the spirit or scope of the invention as set forth herein.

What is claimed:

1. In a fuze for an explosive projectile, particularly a submunition projectile (bomblet), including: a fuze housing; a primary firing pin mounted in said housing for axial displacement in the longitudinal direction; a detonation charge carried by a slide disposed in said housing adjacent said primary firing pin, said slide being mounted in said housing for displacement in a direction transverse to said longitudinal direction of said housing, and to its center longitudinal axis, between a safety position, wherein said detonation charge is not aligned with said primary firing pin, and an armed position, wherein said detonation charge is aligned with said primary firing pin; the improvement comprising: safety means, responsive to centrifugal forces acting on the said fuze, for permitting movement of said slide toward said armed position, and for preventing further movement of said slide toward said armed position beyond an intermediate position, wherein said detonation charge is likewise not aligned with said primary firing pin, if said slide is not in said armed position once a given said centrifugal force is no longer present, said safety means including a first safety pin slidingly mounted in a first opening which is disposed in a side wall of said fuze housing adjacent a first side surface of said slide and which extends transverse to said displacement direction of said slide and to said longitudinal direction, a spring fastened to said housing and urging said first safety pin in a direction toward said first side surface of said slide, and a first recess formed in said first side surface of said slide and into which a first end of said first safety pin can extend, said first recess being an elongated groove extending along said first side surface and having a trailing edge positioned to prevent movement of said slide beyond said intermediate position when engaged by a circumferential surface of said safety pin adjacent said first end.

2. A fuze as defined in claim 1 wherein the said housing has an outer circumferential surface which is provided with an inwardly and rearwardly sloped portion at its lower end; and further comprising a cover for said lower end of said housing, said cover comprising a flat sheet with an upwardly and outwardly sloped peripheral flange for engaging said inwardly sloped portion of said circumferential surface of said housing in a friction locking mutual connection.

3. A fuze as defined in claim 2 wherein said inwardly sloped portion of said outer circumference of said fuze housing has a slope of from 1° to 10°.

4. A fuze as defined in claim 3 wherein said slope is 5°.

5. A fuze as defined in claim 1 further comprises: self destruct means, provided in said slide and including an ignition element disposed at a leading edge surface of said slide, for causing self destruction of at least said fuze after a given time delay following ignition of said ignition element; and a second firing pin mounted at a side wall of said fuze housing at a position facing said leading edge surface of said slide for causing ignition of said ignition element upon displacement of said slide into said armed position; and wherein said leading edge of said slide is spaced from said second firing pin when said slide is in said intermediate position.

6. A fuze as defined in claim 5 further comprising a further spring mounted in said housing for urging said slide in a direction toward said armed position.

7. A fuze as defined in claim 5 wherein the longitudinal extent of said elongated groove is such that said first end of said safety pin can extend into said elongated groove when said slide is in said safety position.

8. A fuze as defined in claim 5 wherein said trailing edge surface of said first recess is inclined toward the rear of said slide and said circumferential surface of said safety pin adjacent said first end is conically tapered with a mating angle of inclination.

9. A fuze as defined in claim 8 wherein said safety pin is provided with said conical taper at both of its ends.

10. A fuze as defined in claim 8 wherein said angle of inclination is between 10° and 45°.

11. A fuze as defined in claim 10 wherein said angle of inclination is approximately 20°.

12. A fuze as defined in claim 5 further comprising a second recess formed in a second side surface of said slide opposite said first side surface, a further safety pin slidingly mounted in a second opening in a side wall of said housing disposed adjacent said second side surface and having a first end which is engageable in said second recess, and a spring fastened to said housing and urging said second safety pin in a direction toward said second side surface of said slide; and wherein said second recess is positioned along said second side surface such that said first end of said second safety pin can extend into said second recess at least when said slide is in said safety position.

13. A fuze as defined in claim 12 wherein said first end of said second safety pin can engage in said second recess only when said slide is in said safety position.

14. A fuze as defined in claim 12 wherein said first and second openings are disposed opposite and aligned with one another.

15. A fuze as defined in claim 12 wherein said spring urging said first safety pin and said spring urging said second safety pin are portions of a common, double-armed wire-shaped spring.

16. A fuze as defined in claim 12 further comprising a sheet metal spring disc disposed adjacent a lower surface of said slide and including an upwardly inclined spring tab for engaging in a further recess in said lower surface of said slide when said slide has moved to said armed position to lock said slide in said armed position, and an upwardly bent peripheral tab which closes an outer end of said first opening in said housing containing said first safety pin.

17. A fuze as defined in claim 13 wherein said housing has an outer circumferential surface which is provided with an inwardly and rearwardly sloped portion at its lower end; and further comprising a cover for said lower end of said housing, said cover comprising a flat sheet with an upwardly and outwardly sloped peripheral flange for engaging said inwardly sloped portion of said circumferential surface of said housing in a friction locking mutual connection.

* * * * *